US011543122B2

(12) United States Patent
Aguado Vela et al.

(10) Patent No.: US 11,543,122 B2
(45) Date of Patent: Jan. 3, 2023

(54) GAS BURNER AND DOMESTIC COOKING APPLIANCE

(71) Applicant: BSH Hausgeräte GmbH, Munich (DE)

(72) Inventors: Cesar Aguado Vela, Camargo (ES); Javier Corral Ricalde, Muriedas (ES); Jose Salvador Ochoa Torres, El Astillero (ES); Julio Rivera Peman, Cuarte de Huerva (ES); Cristina Rueda Sanudo, Escobedo de Camargo (ES)

(73) Assignee: BSH Hausgeräte GmbH, Munich (DE)

( * ) Notice: Subject to any disclaimer, the term of this patent is extended or adjusted under 35 U.S.C. 154(b) by 505 days.

(21) Appl. No.: 16/305,082

(22) PCT Filed: May 12, 2017

(86) PCT No.: PCT/IB2017/052788

§ 371 (c)(1),
(2) Date: Nov. 28, 2018

(87) PCT Pub. No.: WO2017/208095

PCT Pub. Date: Dec. 7, 2017

(65) Prior Publication Data

US 2020/0378597 A1 Dec. 3, 2020

(30) Foreign Application Priority Data

Jun. 3, 2016 (ES) ..... ES201630747

(51) Int. Cl.
*F23D 14/58* (2006.01)
*F23D 14/04* (2006.01)
(Continued)

(52) U.S. Cl.
CPC ..... *F23D 14/58* (2013.01); *F23D 14/04* (2013.01); *F24C 3/008* (2013.01); *F23D 14/06* (2013.01); *F23D 2203/007* (2013.01)

(58) Field of Classification Search
CPC ..... F23D 14/04; F23D 14/06; F23D 14/62; F23D 3/008; F23C 3/002; F23L 1/00; F23L 1/02; F23K 5/002; F23K 5/005
See application file for complete search history.

(56) References Cited

U.S. PATENT DOCUMENTS 858,189 A * 6/1907 Leps ..... F23D 14/06 431/354
1,006,324 A * 10/1911 Werner ..... F23D 14/20 48/189.3
(Continued)

FOREIGN PATENT DOCUMENTS

DE 4421957 A1 * 1/1996 ..... F23D 14/10
DE 4421957 A1 1/1996
(Continued)

OTHER PUBLICATIONS

National Search Report ES P201630747 dated Dec. 22, 2016.
International Search Report PCT/IB2017/052788 dated Aug. 3, 2017.

*Primary Examiner* — Jorge A Pereiro
(74) *Attorney, Agent, or Firm* — Michael E. Tschupp; Andre Pallapies; Brandon G. Braun

(57) ABSTRACT

A gas burner for a household appliance includes a burner housing having a mixing chamber for mixing fuel gas with primary air, a gas nozzle accommodated in the burner housing and configured to inject the fuel gas into the mixing chamber, and an annular first primary air inlet provided between the gas nozzle and the mixing chamber for drawing in the primary air. The gas nozzle has a second primary air inlet which is guided through the nozzle for drawing in the primary air. The second primary air inlet is configured in a direction of flow of the primary air through the second primary air inlet to taper at least once and to widen out again.
(Continued)

The gas nozzle has an annular fuel gas outlet opening which opens directly into the second primary air inlet.

18 Claims, 3 Drawing Sheets

(51) Int. Cl.
*F24C 3/00* (2006.01)
*F23D 14/06* (2006.01)

(56) References Cited

U.S. PATENT DOCUMENTS 2,067,173 A * 1/1937 Dalen ..... F24C 5/02 431/201
2,111,141 A * 3/1938 Dalen ..... F23C 99/00 431/11
3,047,208 A * 7/1962 Coanda ..... F04F 5/16 417/174
3,685,614 A * 8/1972 Coanda ..... F04F 5/42 181/259
3,695,820 A * 10/1972 Hawkes ..... F23D 14/64 239/401
3,806,039 A * 4/1974 Mocarski ..... B05B 1/005 239/425.5
3,807,940 A * 4/1974 Juricek ..... B01F 25/311 431/351
3,850,581 A * 11/1974 Hills ..... F23G 7/065 55/DIG. 20
3,853,457 A * 12/1974 Desty ..... F23G 7/08 431/328
3,909,188 A * 9/1975 Velie ..... F23D 17/002 431/90
4,033,714 A * 7/1977 Longworth ..... F24H 9/1836 239/405
4,073,613 A * 2/1978 Desty ..... F23D 14/62 417/189
4,125,361 A * 11/1978 Bourn ..... E21B 41/0071 239/DIG. 7
4,137,905 A * 2/1979 Longworth ..... F24H 9/1836 122/18.4
4,332,547 A * 6/1982 MacDonald, Jr. .... F23D 11/402 431/247
4,698,014 A * 10/1987 Grethe ..... F23D 11/107 431/11
4,907,964 A * 3/1990 Howarth ..... F23G 7/08 431/202
5,078,324 A * 1/1992 DuBell ..... F23D 11/107 239/419
5,216,040 A 6/1993 Kuroishi et al.
5,735,683 A * 4/1998 Muschelknautz ..... F23G 7/085 431/353
7,090,203 B2 * 8/2006 Goto ..... F02M 19/10 261/118
7,506,496 B2 * 3/2009 Mantchenkov ..... F23D 11/16 60/737
8,266,911 B2 * 9/2012 Evulet ..... F23R 3/286 60/737
8,512,035 B2 * 8/2013 Super ..... F23D 14/70 431/177
9,669,588 B2 * 6/2017 Cavins ..... B29C 70/38
9,764,512 B2 * 9/2017 Cavins ..... B29C 66/472
10,655,845 B2 * 5/2020 Acosta Herrero ..... F24C 3/103
2005/0250065 A1 * 11/2005 Carbone ..... F23D 14/06 431/354
2009/0314000 A1 * 12/2009 Evulet ..... F23R 3/343 60/737
2011/0048400 A1 * 3/2011 Biagioli ..... F23D 14/64 126/39 E
2016/0195268 A1 * 7/2016 Shandong ..... F23D 14/48 431/355
2018/0274781 A1 * 9/2018 Usci ..... F23N 1/022

FOREIGN PATENT DOCUMENTS

GB 224763 11/1924
JP 2013120020 A 6/2013
KR 20160023677 A * 3/2016 ..... F23D 14/64
KR 20160023677 A 3/2016
WO 2010105515 A1 9/2010

* cited by examiner

GAS BURNER AND DOMESTIC COOKING APPLIANCE

CROSS-REFERENCES TO RELATED APPLICATIONS

This application is the U.S. National Stage of International Application No. PCT/IB2017/052788, filed May 12, 2017, which designated the United States and has been published as International Publication No. WO 2017/208095 A1 and which claims the priority of Spanish Patent Application, Serial No. P201630747, filed Jun. 3, 2016, pursuant to 35 U.S.C. 119(a)-(d).

BACKGROUND OF THE INVENTION

The present invention relates to a gas burner for a household cooking appliance and to a household cooking appliance with such a gas burner.

Gas burners for household cooking appliances comprise a lower burner part, in the middle of which a mixing chamber is provided, as well as a nozzle holder, which has a gas nozzle for injecting fuel gas into the mixing chamber. During injection of fuel gas into the mixing chamber primary air is drawn in at the side between the gas nozzle and a lower edge of the mixing chamber and mixed with the fuel gas.

BRIEF SUMMARY OF THE INVENTION

Against this background, the object of the present invention consists of making available an enhanced gas burner.

Accordingly a gas burner for a household appliance is proposed. The gas burner comprises a burner housing, which has a mixing chamber for mixing of fuel gas with primary air, and a gas nozzle accommodated in the burner housing for injecting the fuel gas into the mixing chamber, wherein an annular first primary air inlet to draw in primary air is provided between the housing and the mixing chamber, wherein the gas nozzle has a second primary air inlet guided through said nozzle to draw in primary air, wherein the second primary air inlet, in a direction of flow of the primary air through the second primary air inlet, tapers at least once and widens out again and wherein the gas nozzle has an annular fuel gas outlet opening, which opens directly into the second primary air inlet.

An annular fuel gas outlet opening is to be understood as the fuel gas outlet opening running completely around a central axis or axis of symmetry of the gas burner. The fuel gas outlet opening is in particular slot-shaped. The tapering of the second primary air inlet in the direction of flow of the primary air is to be understood as a cross-sectional surface of the second primary air inlet getting smaller. This means that a diameter of the second primary air inlet reduces in the direction of flow. The widening out of the second primary air inlet in the direction of flow is to be understood as a cross-sectional surface of the second primary air inlet getting larger. This means that a diameter of the second primary air inlet increases in the direction of flow.

The second primary air inlet thus has a choke point or constriction point before which the second primary air inlet tapers and after which the second primary air inlet widens out again. This enables an acceleration of the primary air in the gas nozzle to be achieved. Air, in particular the primary air already mentioned and secondary air, is necessary for burning the fuel gas. The gas nozzle injects the fuel gas into the mixing chamber that is in particular open at the bottom.

Through the injection of the fuel gas a Venturi effect is produced and the primary air is drawn in via the second primary air inlet through the gas nozzle and at the same time is drawn in past the side of the gas nozzle through the primary air inlet into the mixing chamber and mixed there with the fuel gas into a primary air/fuel gas mixture. By contrast the secondary air is the air that is necessary to the burn primary air/fuel gas mixture emerging from the gas burner.

The fact that the annular fuel gas outlet opening opens directly into the second primary air inlet means that a mixing of the fuel gas with the primary air can already take place in the gas nozzle. Furthermore, the fact that two primary air inlets are provided enables the amount of primary air drawn-in to be increased. This makes it possible to burn a larger amount of fuel gas. This enables the performance of the gas burner to be enhanced. The fact that the fuel gas and the primary air are already being mixed at least to some extent in the gas nozzle enables the height of the gas burner to be reduced by comparison with known gas burners. Through the better mixing of the primary air with the fuel gas the efficiency of the gas burner is increased and pollutant emissions are reduced. The gas burner can also be referred to as a household gas burner or as a household cooking appliance gas burner.

In accordance with one form of embodiment the fuel gas outlet opening breaks through an outer wall of the second primary air inlet.

In particular the fuel gas outlet opening opens at the side into the second primary air inlet. During injection of the fuel gas into the mixing chamber a Venturi effect is created at an inlet of the mixing chamber, whereby the primary air is drawn in and mixed with the fuel gas.

In accordance with a further form of embodiment the gas nozzle has an annular fuel gas distribution channel, wherein the fuel gas distribution channel tapers in the direction of the fuel gas outlet opening.

The fuel gas distribution channel is preferably embodied rotationally symmetrical to the central axis of the gas burner. This means that the fuel gas distribution channel runs completely around the central axis. A connecting channel is provided between the fuel gas outlet opening and the fuel gas distribution channel, which can be shaped in the form of a curve, in particular in the form of the arc of a circle. The fact that the fuel gas distribution channel tapers in the direction of the fuel gas outlet opening is to be understood as a cross-sectional surface of the fuel gas distribution channel being larger than a cross-sectional surface of the fuel gas outlet opening.

In accordance with a further form of embodiment the second primary air inlet has an inlet section tapering in a conical shape in the direction of flow of the primary air, an outlet section widening out in a conical shape in the direction of flow of the primary air, which faces towards the mixing chamber, and a cylindrical intermediate section arranged between the inlet section and the outlet section.

The intermediate section preferably has a circular cross-sectional surface. The intermediate section forms a constriction point or a throttle point of the second primary air inlet. The fact that the inlet section tapers in a conical shape in the direction of flow is to be understood as a cross-section or a cross-sectional surface respectively of the inlet section getting smaller in the direction of flow. The fact that the outlet section widens out in a conical shape in the direction of flow is to be understood as a cross-section or a cross-sectional surface respectively of the outlet section getting larger in the direction of flow.

In accordance with a further form of embodiment the fuel gas outlet opening opens into the second primary air inlet between the intermediate section and the outlet section.

In particular the fuel gas outlet opening opens into the second primary air inlet immediately after the intermediate section. This means that the fuel gas is injected into said inlet immediately after the constriction point of the second primary air inlet. This enables the fuel gas already to be mixed especially well with the primary air in the gas nozzle.

In accordance with a further form of embodiment the gas nozzle is embodied rotationally symmetrical to a central axis, wherein the second primary air inlet is likewise embodied rotationally symmetrical to the central axis.

Preferably the gas nozzle has a base body formed from a metal material. For example the gas nozzle can be made of brass. Also provided in the base body is a fuel gas distribution channel.

In accordance with a further form of embodiment the burner housing comprises a lower burner part, which has the mixing chamber, and a nozzle holder connected to the lower burner part, in which the gas nozzle is accommodated.

Furthermore the burner housing can have a burner cover laid on top of the lower burner part. The burner cover, the lower burner part and the nozzle holder can be embodied as die-cast aluminum parts for example. This enables the gas burner to be manufactured at low cost in large volumes. The gas burner is installed on a top sheet. The top sheet here can be arranged between the nozzle holder and the lower burner part. All gas burners of the household appliance are assigned to the top sheet. This means that the household appliance has only one top sheet, on which all gas burners are installed.

In accordance with a further form of embodiment the nozzle holder has a fuel gas channel for supplying the fuel gas to the gas nozzle.

A fuel gas distribution channel, into which the fuel gas channel opens, can furthermore be provided in the nozzle holder. The fuel gas distribution channel can be embodied as an annular channel and run all around the second primary air inlet. The fuel gas distribution channel of the nozzle holder can make a fluid connection with the fuel gas distribution channel of the gas nozzle via connecting channels.

In accordance with a further form of embodiment the second primary air inlet is embodied at least partly in the nozzle holder.

For example a drawing-in section tapering in a conical shape in the direction of flow of the primary air and also a supply section for supplying the primary air drawn in through the drawing-in section to the gas nozzle can be provided.

A household appliance, in particular a gas stove, with a gas burner of this type, is further proposed.

Preferably the household appliance has a plurality of such gas burners. A gas control valve or gas regulation valve can be assigned to each gas burner. The household appliance furthermore has a common top sheet, on which all gas burners are installed. The top sheet can be a glass ceramic sheet for example. The household appliance can be a freestanding appliance or a built-in appliance. Preferably the household appliance is a household gas stove. For example the household appliance can have four gas burners of this type. The gas regulation valve is clamped to a main gas line of the household appliance and has a fluid connection to the gas burner assigned to it via a gas supply line. Furthermore each gas burner can be assigned an ignition device, which can be integrated into the gas regulation valve, and an ignition element assigned to the gas burner, for example a spark ignition device.

Further possible implementations of the gas burner and/or of the household cooking appliance also comprise combinations of features or forms of embodiment not previously explicitly stated, described above or below in relation to the exemplary embodiments. In such cases the person skilled in the art will also add individual aspects as improvements or expansions to the respective basic form of the gas burner and/or of the household appliance.

BRIEF DESCRIPTION OF THE DRAWINGS

Further advantageous embodiments and aspects of the gas burner and/or of the household cooking appliance are the subject matter of the subclaims as well as the exemplary embodiments of the gas burner and/or of the household cooking appliance described below. The gas burner and/or of the household cooking appliance will be explained in greater detail below with reference to the enclosed figures.

DETAILED DESCRIPTION OF EXEMPLARY EMBODIMENTS OF THE PRESENT INVENTION

Figure 1:
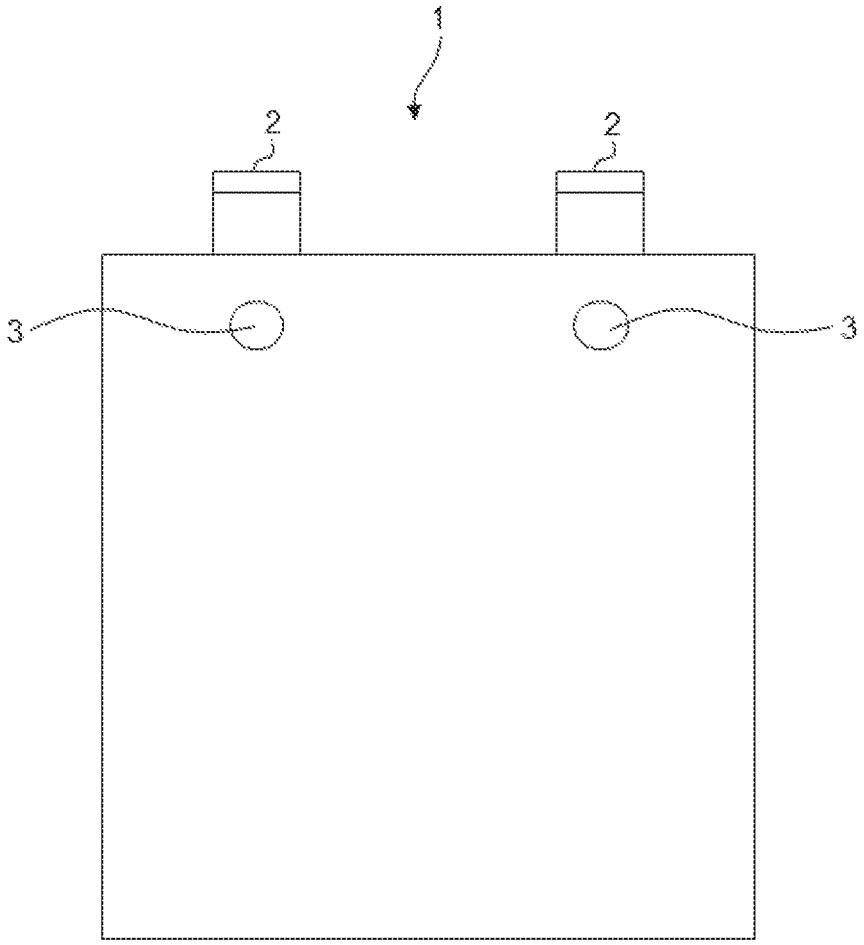
FIG. 1 shows a schematic view of a form of embodiment of a household cooking appliance.

Elements that are the same or that function in the same way have been labeled with the same reference characters, unless stated otherwise.

FIG. 1 shows a schematic view of a form of embodiment of a household cooking appliance 1. The household cooking appliance 1 is in particular a gas stove or household gas stove. The household cooking appliance 1 can be a built-in appliance or a freestanding appliance. The household cooking appliance 1 comprises a number of gas burners 2. There can be any given number of gas burners 2. For example four gas burners 2 can be provided. Each gas burner 2 is assigned a gas control valve or gas regulation valve 3, with the aid of which a fuel gas flow supplied to the respective gas burner 2 can be optionally switched on, switched off and can be regulated, in particular steplessly.

Figure 2:
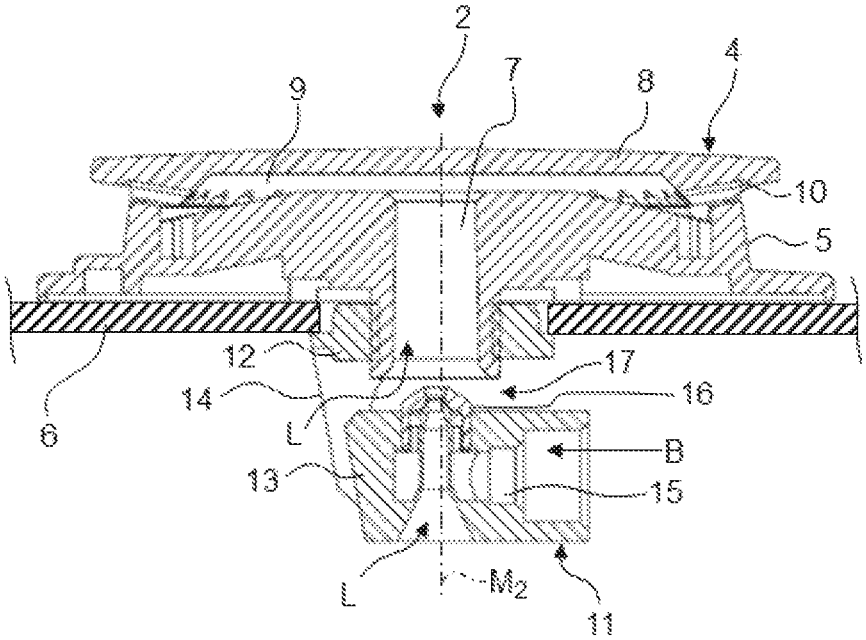
FIG. 2 shows a schematic sectional view of a form of embodiment of a gas burner for the household cooking appliance as depicted in FIG. 1.
Figure 3:
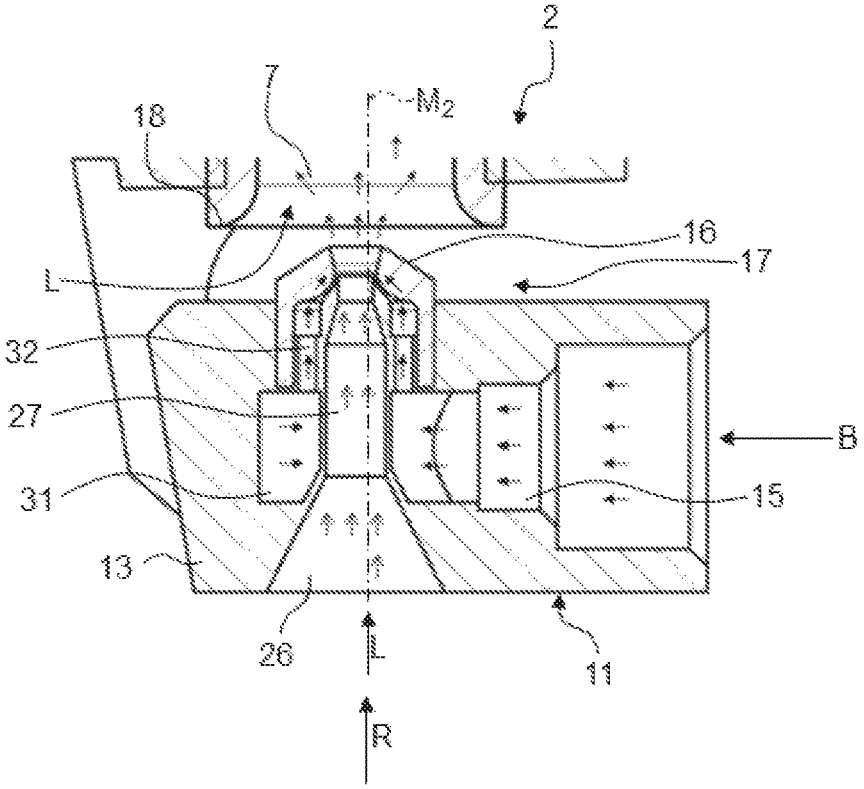
FIG. 3 shows a further schematic sectional view of the gas burner as depicted in FIG. 2.

FIGS. 2 and 3 respectively show a schematic sectional view of a form of embodiment of a gas burner 2 for the household cooking appliance 1. The gas burner 2 comprises a burner housing 4. The burner housing 4 is preferably made of an aluminum or magnesium alloy. The burner housing 4 comprises a lower burner part 5, which rests on a cooktop or top sheet 6. The cooktop can also be referred to as the top sheet 6. The top sheet 6 is for example a metal sheet or a glass ceramic sheet. All gas burners 2 of the household appliance 1 are fastened to the top sheet 6. This means that a common top sheet 6 is allocated to all gas burners 2.

The lower burner part 5 is embodied rotationally symmetrical to a central axis or an axis of symmetry $M_2$ of the gas burner 2. A tubular mixing chamber 7 is provided centrally in the lower burner part 5. The mixing chamber 7 is likewise embodied rotationally symmetrical to the central axis $M_2$. The mixing chamber 7 is configured to mix fuel gas B, for example natural gas, with fresh air or primary air L. Laid on top of the lower burner part 5 is a burner cover 8.

A gas distribution chamber 9 is formed between the burner cover 8 and the lower burner part 5 for evenly distributing a primary air/fuel gas mixture formed in the mixing chamber 7 to a plurality of gas outlet openings 10 provided on the edge of the burner cover 8. There can be any number of gas outlet openings 10. The gas outlet openings 10 are arranged distributed evenly around a circumference of the burner cover 8. The burner cover 8 is likewise embodied rotationally symmetrical to the central axis $M_2$.

With the aid of the gas distribution chamber 9 the primary air/fuel gas mixture created in the mixing chamber 7 is able to be distributed evenly to the gas outlet openings 10. In addition the mixing of the primary air L with the fuel gas B can be further improved in the gas distribution chamber 9. This means that there can be a premixing of the fuel gas B and primary air L in the mixing chamber 7 and the full mixing can be continued in the gas distribution chamber 9.

The burner housing 4 furthermore comprises a nozzle holder 11. The nozzle holder 11 is arranged below the top sheet 6. For example the top sheet 6 can be fixed by a clamp between the lower part of the burner 5 and the nozzle holder 11. To this end a breakthrough can be provided in the top plate 6. The nozzle holder 11 has an annular fastening section 12, which is connected permanently to the lower part of the burner 5. An outer thread can be provided for this purpose for example on the outside of the mixing chamber 7, which is screwed into a corresponding inner thread of the fastening section 12.

The nozzle holder 11 furthermore comprises a nozzle receiving section 13, which is connected via a web section 14 in one piece to the fastening section 12. In particular the fastening section 12, the nozzle receiving section 13 and the web section 14 are embodied as one piece of material. The nozzle holder 11, the lower part of the burner 5 and the burner cover 8 can for example be embodied as aluminum die cast components. This enables the gas burner 2 to be manufactured at low cost in large volumes.

The nozzle holder 11 furthermore comprises a fuel gas channel 15 provided in the nozzle receiving section 13 for supplying the fuel gas B to a gas nozzle 16 of the gas burner 2. With the aid of the gas nozzle 16 the fuel gas B can be injected into the mixing chamber 7. An annular, circumferential first primary air inlet 17 is provided between the gas nozzle 16 and the mixing chamber 7. The gas nozzle 16 is arranged spaced apart from the lower edge 18 of the mixing chamber 7. This means that the gas nozzle 16 is positioned entirely outside the mixing chamber 7. During injection of the fuel gas B with the aid of the gas nozzle 16 into the mixing chamber 7, primary air L is drawn in at the side via the first primary air inlet 17. The gas nozzle 16 thus causes a Venturi effect.

Figure 4:
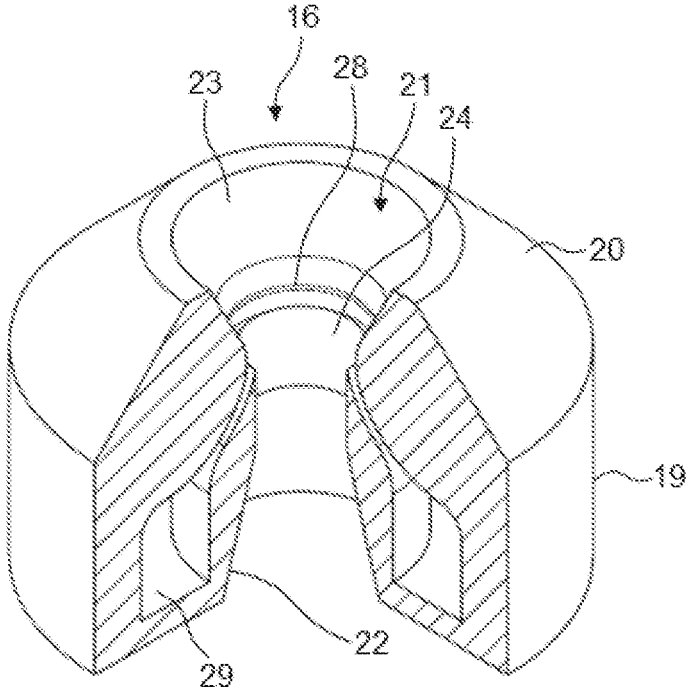
FIG. 4 shows a schematic perspective part sectional view of a form of embodiment of a gas nozzle for the gas burner as depicted in FIG. 2.
Figure 5:
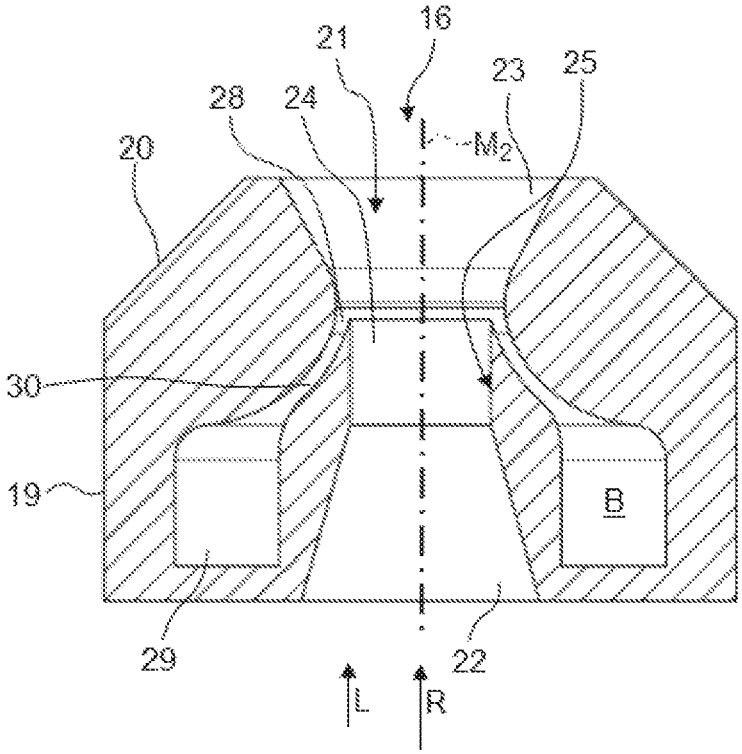
FIG. 5 shows a schematic sectional view of the gas nozzle as depicted in FIG. 4.

A form of embodiment of the gas nozzle 16 is shown in FIGS. 4 and 5. The gas nozzle 16 is likewise embodied rotationally symmetrical to the central axis M2. The gas nozzle 16 comprises a cylindrical base body 19, which is preferably made of a metal material. In particular the base body 19 can be made of brass. The base body 19 has an optional chamfer 20 facing towards the mixing chamber 7. The chamfer 20 can make an angle of 45° with the central axis M2 for example. The chamfer 20 makes it easier for the primary air L to flow past the gas nozzle 16 into the mixing chamber 7.

The gas nozzle 16 further comprises a second primary air inlet 21 guided centrally through said nozzle. Primary air L is likewise drawn in through the second primary air inlet 21 and supplied to the mixing chamber 7. The second primary air inlet 21 is a hole provided in the center of the base body 19. The second primary air inlet 21 tapers in a direction of flow R of the primary air L at least once and subsequently widens out again in the direction of flow R. In particular the second primary air inlet 21 comprises a conical inlet section 22 tapering in the direction of flow R of the primary air L, a conical outlet section 23 widening out in the direction of flow R, which faces towards the mixing chamber 7, and a cylindrical intermediate section 24 arranged between the inlet section 22 and the outlet section 23.

The inlet section 22 tapering in a conical shape in the direction of flow R of the primary air L is to be understood as a cross-section or a cross-sectional surface of the inlet section 22 becoming smaller in the direction of flow R. The outlet section 23 widening out in a conical shape in the direction of flow R is to be understood as a cross-section or a cross-sectional surface respectively of the outlet section 23 becoming larger in the direction of flow R. The intermediate section 24 is preferably cylindrical with a circular basic surface.

The inlet section 22, the outlet section 23 and the intermediate section 24 form an outer wall 25 of the second primary air inlet 21. The second primary air inlet 21 can be embodied, as shown in FIGS. 2 and 3, at least partly in the nozzle holder 11. For example a drawing-in section 26 tapering in the direction of flow R of the primary air L is provided in the nozzle receiving section 13 of the nozzle holder 11, which opens into a cylindrical supply section 27. With the aid of the supply section 27 the primary air L is supplied to the gas nozzle 16. The supply section 27 is arranged in this case between the inlet section 22 and the drawing-in section 26.

The gas nozzle 16 furthermore has an annular fuel gas outlet opening 28. Annular is to be understood as the fuel gas outlet opening 28 running completely around the central axis $M_2$. The fuel gas outlet opening 28 is in the shape of a slot. The fuel gas outlet opening 28 opens directly into the second primary air inlet 21. In doing so the fuel gas outlet opening 28 breaks through the outer wall 25 of the second primary air inlet 21.

Also provided in the base body 19 of the gas nozzle 16 is an annular fuel gas distribution channel 29 running completely around the central axis $M_2$ and embodied rotationally symmetrical to said axis, for even distribution of the fuel gas B. The fuel gas distribution channel 29 tapers in the direction of the fuel gas outlet opening 28. This means that the fuel gas distribution channel 29 has a larger cross-section than the fuel gas outlet opening 28. Provided between the fuel gas outlet opening 28 and the fuel gas distribution channel 29 is a connecting channel 30 curved in the shape of an arc.

The fuel gas outlet opening 28 opens into the second primary air inlet 21 immediately after the intermediate section 24 of the primary air inlet 21. In particular the fuel gas outlet opening 28 opens into the second primary air inlet 21 between the intermediate section 24 and the outlet section 23.

As FIGS. 2 and 3 show, the fuel gas channel 15 provided in the nozzle receiving section 13 comprises an annular fuel gas distribution channel 31 running around the supply section 27 and the drawing-in section 26, with the aid of which the fuel gas B is supplied to the fuel gas distribution channel 29 of the gas nozzle 16. To this end a connecting channel or a number of connecting channels 32 can be provided in the nozzle receiving section 13. The connecting channels 32 can be embodied as holes.

The functionality of the gas burner will be explained below. In operation of the gas burner 2 fuel gas B is supplied to said burner via the fuel gas channel 15. The fuel gas B flows through the fuel gas outlet opening 28 in an annular shape into the second primary air inlet 21. Through this primary air L is drawn in via the drawing-in section 26 into the gas nozzle 16 and in particular into the second primary air inlet 21. The fact that the second primary air inlet 21 tapers in the direction of flow R of the primary air L means that the primary air L is accelerated and still mixes in the gas nozzle 16 at least partly with the fuel gas B. On exit of the primary air/fuel gas mixture from the gas nozzle 16, further primary air L is drawn into the mixing chamber 7 from the side via the first primary air inlet 17. In the mixing chamber 7 there is a further full mixing of the fuel gas B with the primary air L.

By two primary air inlets 17, 21 being provided, by comparison with known gas burners, an increased amount of primary air L can be drawn in. This also enables a larger amount of fuel gas B to be burned and thus the performance of the gas burner 2 to be enhanced by comparison with known gas burners. The premixing of the primary air L with the fuel gas B can already take place in the gas nozzle 16 in a very restricted space. This enables the gas burner 2 to be constructed lower by comparison with known gas burners. The combustion of the fuel gas B is improved since the mixing of the fuel gas B with the primary air L is more homogeneous. The output of emissions is reduced and the efficiency of the gas burner 2 is enhanced.

The invention claimed is:

1. A gas burner for a household appliance, said gas burner comprising:

a burner housing having a mixing chamber for mixing fuel gas with primary air, a gas nozzle accommodated in the burner housing and configured to inject the fuel gas into the mixing chamber, and an annular first primary air inlet provided between the gas nozzle and the mixing chamber for drawing in the primary air, said gas nozzle having:

a second primary air inlet which is guided through the nozzle for drawing in the primary air, said second primary air inlet being configured in a direction of flow of the primary air through the second primary air inlet to taper at least once and to widen out again, an annular fuel gas outlet opening which opens directly into the second primary air inlet, an annular fuel gas distribution channel configured to taper in a direction of the annular fuel gas outlet opening, and a connecting channel connecting the annular fuel gas distribution channel with the annular fuel gas outlet opening, the connecting channel being curved in a shape of an arc.

2. The gas burner of claim 1, wherein the fuel gas outlet opening breaks through an outer wall of the second primary air inlet.

3. The gas burner of claim 1, wherein the second primary air inlet includes an inlet section tapering conically in the direction of flow of the primary air, an outlet section widening out conically in the direction of flow of the primary air and facing towards the mixing chamber, and a cylindrical intermediate section arranged between the inlet section and the outlet section.

4. The gas burner of claim 3, wherein the fuel gas outlet opening opens into the second primary air inlet between the intermediate section and the outlet section.

5. The gas burner of claim 1, wherein the gas nozzle is configured rotationally symmetrical to a central axis of the gas burner, said second primary air inlet being configured rotationally symmetrical to the central axis.

6. The gas burner of claim 1, wherein the burner housing includes a lower burner part which houses the mixing chamber, and a nozzle holder which is connected to the lower burner part and accommodates the gas nozzle.

7. The gas burner of claim 6, wherein the nozzle holder includes a fuel gas channel for supplying the fuel gas to the gas nozzle.

8. The gas burner of claim 6, wherein the second primary air inlet is configured at least in part in the nozzle holder.

9. A household appliance, comprising a gas burner, said gas burner comprising a burner housing having a mixing chamber for mixing fuel gas with primary air, a gas nozzle accommodated in the burner housing and configured to inject the fuel gas into the mixing chamber, and an annular first primary air inlet provided between the gas nozzle and the mixing chamber for drawing in the primary air, said gas nozzle having a second primary air inlet which is guided through the nozzle for drawing in the primary air, said second primary air inlet being configured in a direction of flow of the primary air through the second primary air inlet to taper at least once and to widen out again, said gas nozzle having: an annular fuel gas outlet opening which opens directly into the second primary air inlet, an annular fuel gas distribution channel configured to taper in a direction of the annular fuel gas outlet opening, and a connecting channel connecting the annular fuel gas distribution channel with the annular fuel gas outlet opening, the connecting channel being curved in a shape of an arc.

10. The household appliance of claim 9, constructed in the form of a gas stove.

11. The household appliance of claim 9, wherein the fuel gas outlet opening breaks through an outer wall of the second primary air inlet.

12. The household appliance of claim 9, wherein the second primary air inlet includes an inlet section tapering conically in the direction of flow of the primary air, an outlet section widening out conically in the direction of flow of the primary air and facing towards the mixing chamber, and a cylindrical intermediate section arranged between the inlet section and the outlet section.

13. The household appliance of claim 12, wherein the fuel gas outlet opening opens into the second primary air inlet between the intermediate section and the outlet section.

14. The household appliance of claim 9, wherein the gas nozzle is configured rotationally symmetrical to a central axis of the gas burner, said second primary air inlet being configured rotationally symmetrical to the central axis.

15. The household appliance of claim 9, wherein the burner housing includes a lower burner part which houses the mixing chamber, and a nozzle holder which is connected to the lower burner part and accommodates the gas nozzle, wherein the nozzle holder includes:

a drawing-in section tapering in the direction of flow of the primary air, and a supply section in communication with the second primary air inlet of the gas nozzle, the supply section connecting the drawing-in section to the second primary air inlet of the gas nozzle.

16. The household appliance of claim 9, further comprising:

a cooktop, wherein a part of the burner housing is on the cooktop, and wherein the second primary air inlet includes an inlet section tapering conically in the direction of flow of the primary air, an outlet section widening out conically in the direction of flow of the primary air, and a cylindrical intermediate section arranged between the inlet section and the outlet section and immediately before the outlet section, the outlet section facing towards the mixing chamber and opening directly into the annular first primary air inlet, wherein the annular fuel gas outlet opening opens into the second primary air inlet between the intermediate section and the outlet section and immediately before the outlet section.

17. A household appliance comprising:

a cooktop;

a gas burner having a burner housing at least partially disposed on the cooktop, wherein the burner housing includes:

a lower burner part having a mixing chamber for mixing fuel gas with primary air, and a gas distribution chamber configured to distribute a primary air/fuel gas mixture formed in the mixing chamber to a plurality of gas outlet openings of the gas burner;

a nozzle holder below the cooktop;

a gas nozzle supported by the nozzle holder, the gas nozzle configured to inject the fuel gas into the mixing chamber for mixing the fuel gas with the primary air; and an annular first primary air inlet provided between the gas nozzle and the mixing chamber for drawing in the primary air, wherein the gas nozzle includes:

a second primary air inlet extending through a body of the gas nozzle for drawing in the primary air, said second primary air inlet being configured in a direction of flow of the primary air through the second primary air inlet to taper at least once and to widen out again, an annular fuel gas outlet opening which opens directly into the second primary air inlet, and an annular fuel gas distribution channel in communication with the annular fuel gas outlet opening, the annular fuel gas distribution channel configured to taper in a direction of the fuel gas outlet opening; and wherein the nozzle holder includes:

a drawing-in section tapering in the direction of flow of the primary air, a supply section in communication with the second primary air inlet of the gas nozzle, the supply section connecting the drawing-in section to the second primary air inlet of the gas nozzle, a fuel gas channel for supplying the fuel gas to the gas nozzle, the fuel gas channel of the nozzle holder being in communication with the annular fuel gas distribution channel of the gas nozzle, and a connecting channel connecting the annular fuel gas distribution channel with the annular fuel gas outlet opening, the connecting channel being curved in a shape of an arc.

18. The household appliance of claim 17, wherein the supply section is a cylindrical supply section.

* * * * *